US005512003A

United States Patent [19]

Parker

[11] Patent Number: 5,512,003

[45] Date of Patent: Apr. 30, 1996

[54] SIMULATED VOLCANO TOY MOLD

[76] Inventor: Robin L. Parker, P.O. Box 110024, Anchorage, Ak. 99511-0024

[21] Appl. No.: 364,960

[22] Filed: Dec. 28, 1994

[51] Int. Cl.[6] ..... A63H 33/30; A63H 29/00; A63H 13/16

[52] U.S. Cl. ..... 446/475; 446/429; 446/310; 124/79

[58] Field of Search ..... 273/440, 445, 273/451, 129 P; 124/79, 1; 446/197, 198, 429, 473, 475, 308, 309, 310, 311, 314, 315, 361, 5

[56] References Cited

U.S. PATENT DOCUMENTS

| | | | |
|---|---|---|---|
| 475,486 | 5/1892 | Carpenter | 446/315 X |
| 898,350 | 9/1908 | Foster | 273/324 |
| 1,170,948 | 2/1916 | Achershaug | 273/324 |
| 1,650,762 | 11/1927 | Machin | 446/5 |
| 3,333,360 | 8/1967 | Hardy | 446/475 X |
| 3,464,694 | 9/1969 | Stan et al. | 273/445 |
| 3,570,765 | 3/1971 | de Gast | 446/166 X |
| 4,209,113 | 6/1980 | Kuna | 446/475 X |
| 4,266,778 | 5/1981 | Sine | 124/79 X |
| 5,052,973 | 10/1991 | Rudell et al. | 124/79 X |

FOREIGN PATENT DOCUMENTS

| | | | |
|---|---|---|---|
| 93488 | 7/1923 | Austria | 446/197 |
| 1296825 | 3/1987 | U.S.S.R. | 446/475 |

*Primary Examiner*—Mickey Yu
*Assistant Examiner*—D. Neal Muir
*Attorney, Agent, or Firm*—Michael J. Tavella

[57] ABSTRACT

A new type of simulated volcano toy is described. It uses a formed mold to create the outer shell of the volcano. A tubular insert is used to ensure the center opening is properly formed. Once the shell is made, a disk is placed at the bottom of the eruption tube. A length of ribbon or string is placed through slots formed in the disk. The ribbon ends are placed out of the eruption tube and are allowed to fall over the sides of the shell. The eruption tube can then be filled with whatever the user desires. For example, candy, plastic pellets, confetti, small toys etc. The user then grasps the ribbon ends and pulls them sharply. This causes the disk in the bottom to be quickly pulled up, out of the eruption tube. As the disk is being pulled upward, all of the material placed over the disk in the eruption tube is thrown upwards and out of the eruption tube by the disk. This creates an "eruption" that is entertaining.

10 Claims, 7 Drawing Sheets

SIMULATED VOLCANO TOY MOLD

This invention relates to simulated volcano toy molds and particularly to simulated volcano toy molds having a center tube and an eruption disk placed therein.

BACKGROUND OF THE INVENTION

Numerous toy volcanoes have been created over time. Some of these toys use common household chemicals to cause a simulated "eruption". These toys are messy because the chemicals tend to spray upward and outwards. Thus, although these toys do work, they are limited in use. Moreover, these toys are generally made of molded plastics and are limited in size and shape to what the manufacturer provides.

SUMMARY OF THE INVENTION

The present invention overcomes these limitations. It uses a formed mold to create the outer shell of a simulated toy volcano. A cylindrical tube insert is provided to ensure the hollow center opening is properly formed. Depending on the type of shell material used, the cylindrical tube insert may be removed once the shell material has cured. Once the shell is made, a disk is placed at the bottom of the hollow center opening (or the cylindrical tube if needed). This hollow center or cylindrical tube is called an eruption tube A length of ribbon or string is placed through slots formed in the disk. The ribbon ends are placed out of the eruption tube and are allowed to fall over the sides of the shell. The eruption tube can then be filled with whatever the user desires as "eruption objects." For example, candy, plastic pellets, confetti, small toys etc. can be used as eruption objects. To create an eruption, the user then grasps the ribbon ends and pulls them sharply. This causes the disk in the bottom to be quickly pulled up, out of the eruption tube. As the disk is being pulled upward, all of the material placed over the disk in the eruption tube is thrown upwards and out of the eruption tube by the disk. This creates an "eruption" that is entertaining.

The shell can be made from any material that can be molded into a solid, stable shape. Thus, a cake mix can be baked into a mold, gelatin dessert products such as JELL-O can be formed within the mold, wet sand on a beach can be used. The list of materials is limited only by the material's ability to hold its shape when the mold is removed.

The volcano parts can be stored together as a unit. A strap is provided to secure the parts to the outside of the mold; or, if desired, these parts can be stored in the mold, protected by a cover. Storing the parts on the side of the mold form allows a number of mold forms to be stacked for storage or shipment.

It is an object of this invention to provide a mold and eruption system for a volcano toy that does not require chemicals to cause a simulated eruption.

It is another object of this invention to provide a simulated volcano toy that can create the volcano shell from a wide variety of materials.

It is a further object of this invention to produce a volcano toy that can use a variety of materials as eruption products.

It is yet another object of this invention to produce a volcano toy that can store and hold all of the essential components in one package, thereby providing a convenient storage system for the toy.

DETAILED DESCRIPTION OF THE INVENTION

Figure 1:
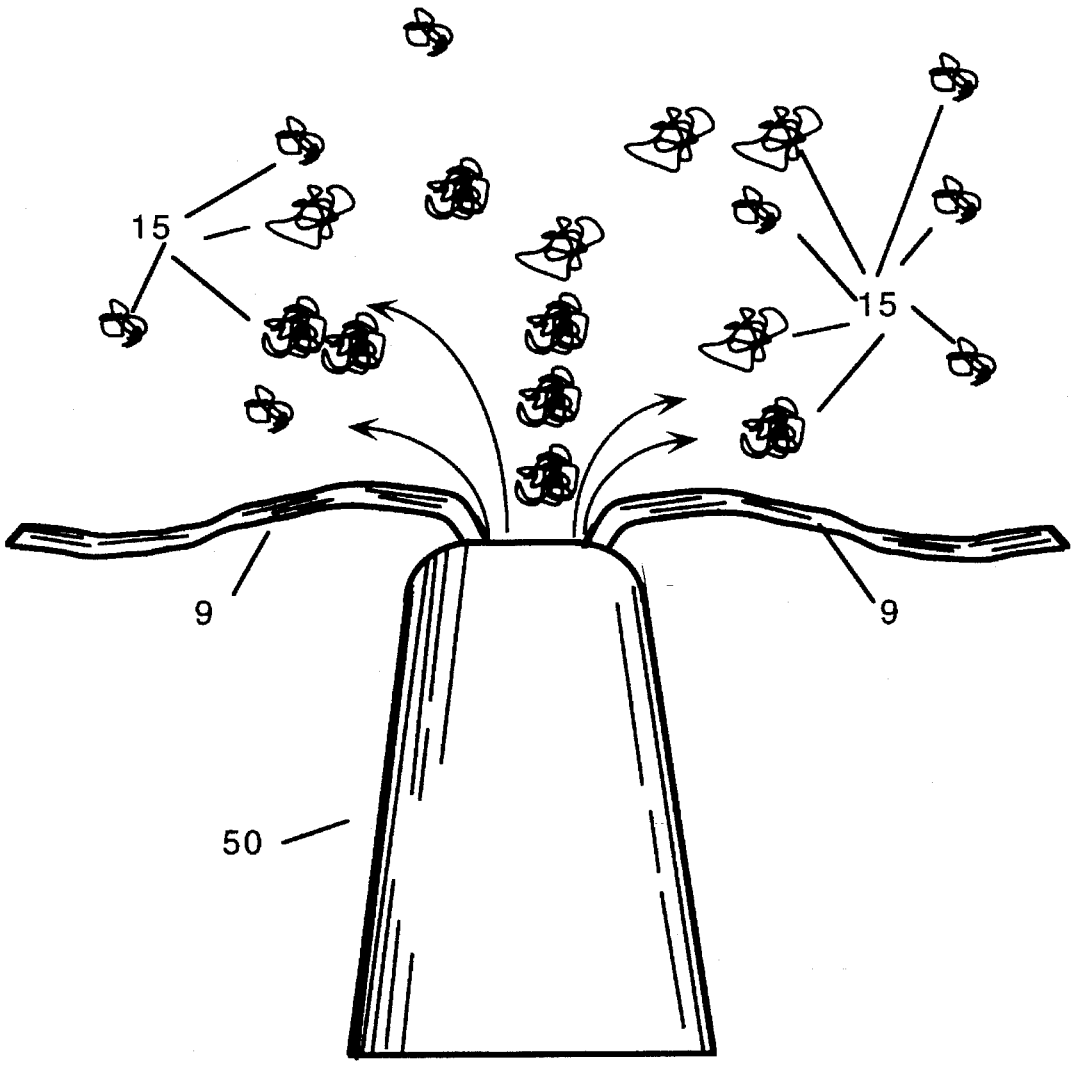
FIG. 1 is a side view of the invention in operation.
Figure 2A:
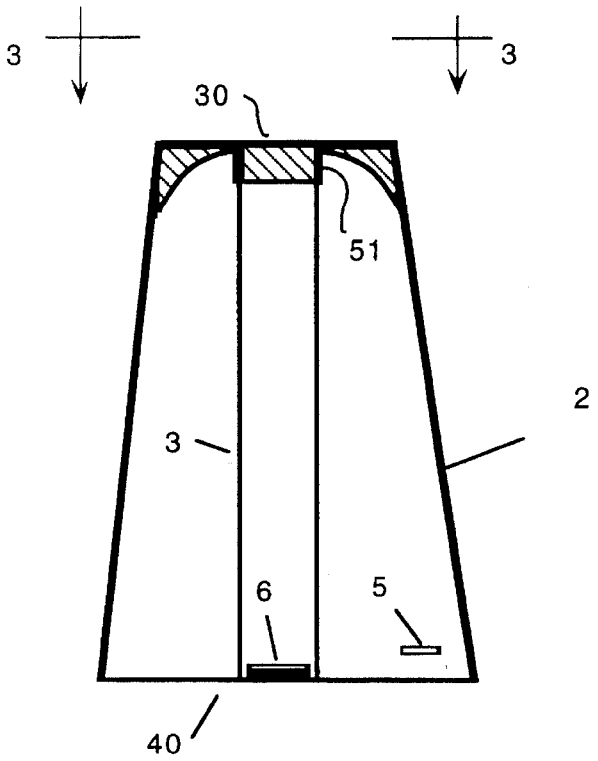
FIG. 2*a* is a cross-sectional view of the mold form, through the center.
Figure 2B:
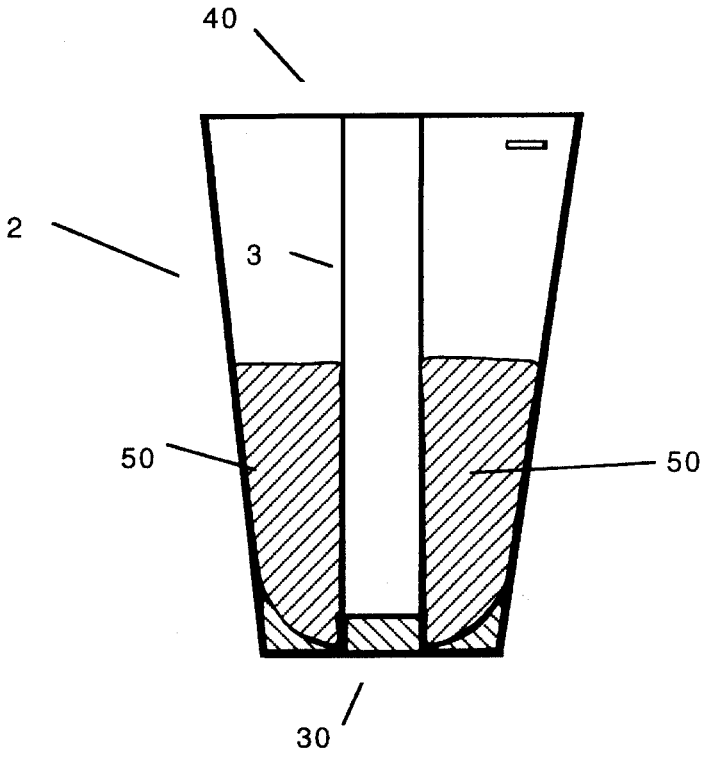
FIG. 2*b* is a cross-sectional view of the mold form, through the center, inverted and partially filed with moldable shell material.
Figure 3:
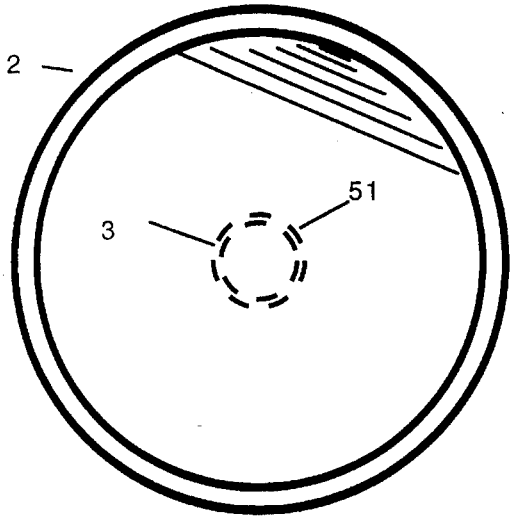
FIG. 3 is a top view of the invention taken along the lines 3—3.

Referring now to the drawings, and particularly FIGS. 1 through 10, the invention 1 has three main components. First, is a mold form 2. This mold form 2 has sloped sides as shown in FIG. 2*a*. The mold form 2 has a solid top 30 as shown in FIG. 3, and an open bottom 40. It is intended that the mold form 2 has the general shape of a volcano. The most basic shape of the mold form 2, is a tapered cylinder. If desired, the mold form 2 can be shaped with folds and other features to make it appear more like a mountain. The mold form 2 is used to form the outer volcano shell 50 using any suitable moldable material ranging from beach sand to cake mix to gelatin dessert mixes such as JELL-O.

The mold form 2 can be made of suitable materials for the desired purpose. The components can be made of plastic, ceramics or metals. Choice of materials depends on the intended use. For baking a cake type molded volcano, a plastic form mold is not suitable. However, for all other non-heat molding methods, plastic is the preferred material.

To form the volcano shell 50, the mold form 2 is inverted so that the solid top 30 is at the bottom and the open bottom 40 is at the top as shown in FIG. 2*b*. The mold form 2 is then filled with the desired filling material that is used to form the volcano shell 50. See FIG. 2*b*. Once the mold is full, a lid 20 is placed over the open bottom 40 to prevent unwanted contaminants from entering the mold. See FIG. 15. Once the shell material has cured, baked or has otherwise solidified sufficiently, the lid 20 is removed, the mold form 2 is inverted and removed from the volcano shell 50. The curing of the shell material is based on the material's curing characteristics e.g., for gelatin, a cold set is needed, for cake, baking is required, etc.

To create the volcano effect, a hollow cylindrical center is formed within the volcano shell 50 using an eruption tube 3. A ring 51 is formed in the top of the mold form 2 to hold the eruption tube 3 in place during the molding.

Figure 5:
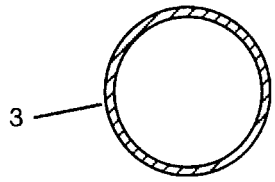
FIG. 5 is a top view of the eruption tube taken along the lines 5—5.
Figure 4:
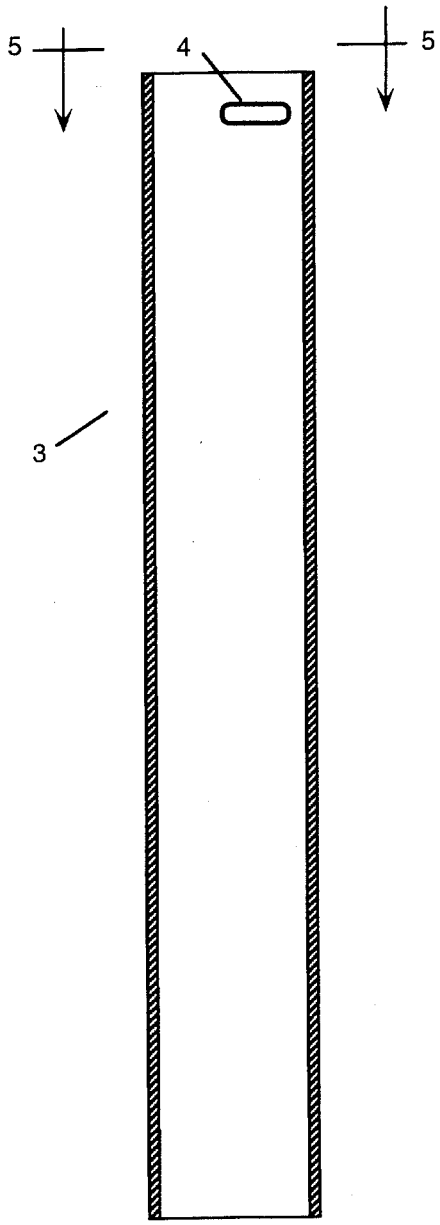
FIG. 4 is a detail view of the eruption tube.

FIGS. 4 and 5 show the eruption tube 3. The eruption tube 3 is a simple open cylinder as shown. The eruption tube 3 is placed into the center of the mold form 2. See, FIG. 3. The eruption tube 3 provides a solid structure to ensure that the eruption operates smoothly. Where certain forms of materials are used to create a volcano shell 50, the eruption tube 3 may be removed after the shell material has cured. Note that for ease of description, the term eruption tube is used to describe the place where the eruption disk and eruption objects are placed even in the case described above where the actual tube 3 is removed.

A slot 4 is provided in the eruption tube 3 as shown to secure the tube for storage (discussed below). A similar slot 5 is provided on the mold form 2 as shown.

Figure 6:
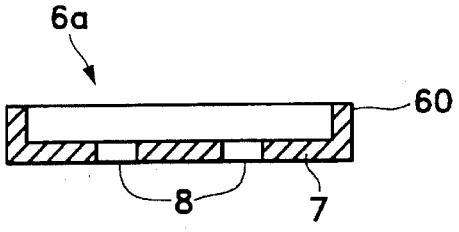
FIG. 6 is a side cross-sectional view of an eruption disk with high walled sides.
Figure 7:
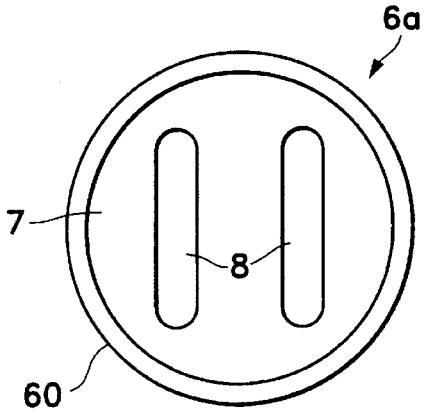
FIG. 7 is a top view of an eruption disk with high walled sides.
Figure 8:
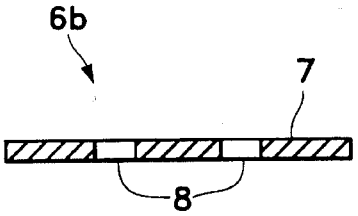
FIG. 8 is a side cross-sectional view of an eruption disk without high walled sides.
Figure 9:
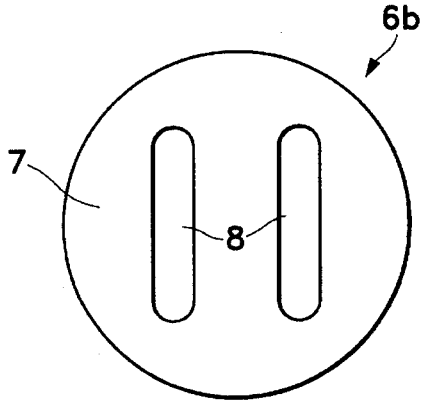
FIG. 9 is a top view of an eruption disk without high walled sides.

The third component is an eruption disk 6. The eruption disk 6 is shown in FIGS. 6–10. Two different forms of eruption disk 6 are shown. FIGS. 6 and 7 and show an eruption disk 6*a*, which has a base 7, two slots 8 and a side wall 60. FIGS. 8 and 9 show an eruption disk 6*b*, which has a base 7, and two slots 8, as before, but lacks the side wall 60. The disk 6*b* is preferred because the lack of a side wall helps the disk move easier through the eruption tube 3.

Figure 10:
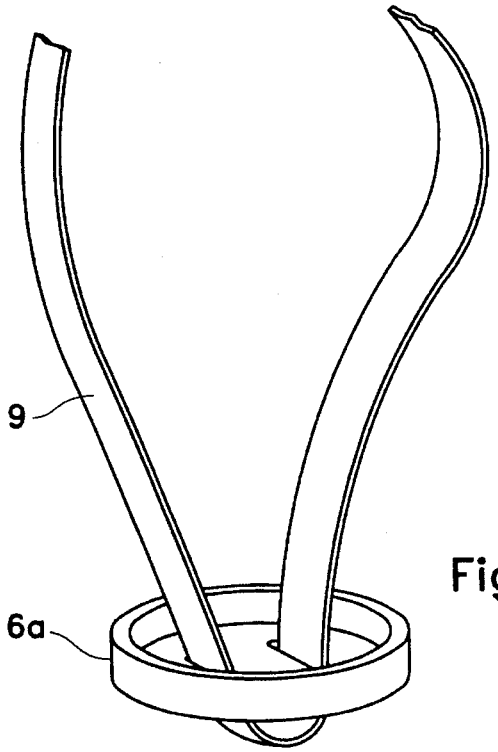
FIG. 10 is a perspective view of the eruption disk with high walled sides and with the ribbon installed.

FIG. 10 shows eruption disk 6*a* with a ribbon 9. The ribbon 9 is passed through a pair of slots 8 as shown. This arrangement allows the ribbon 9 to pull the eruption disk 6 upwards and out of the eruption tube 3. To prevent the ribbon 9 from being pulled out of the disk (e.g., if one end of the ribbon 9 is pulled harder than the other) the ribbon 9 can be knotted on the underside of the eruption disk 6. This ensures that the ribbon 9 cannot be pulled out of the eruption disk 6.

As shown in FIG. 2*a*, the eruption disk 6 is placed in the bottom of the eruption tube 3.

Figure 11:
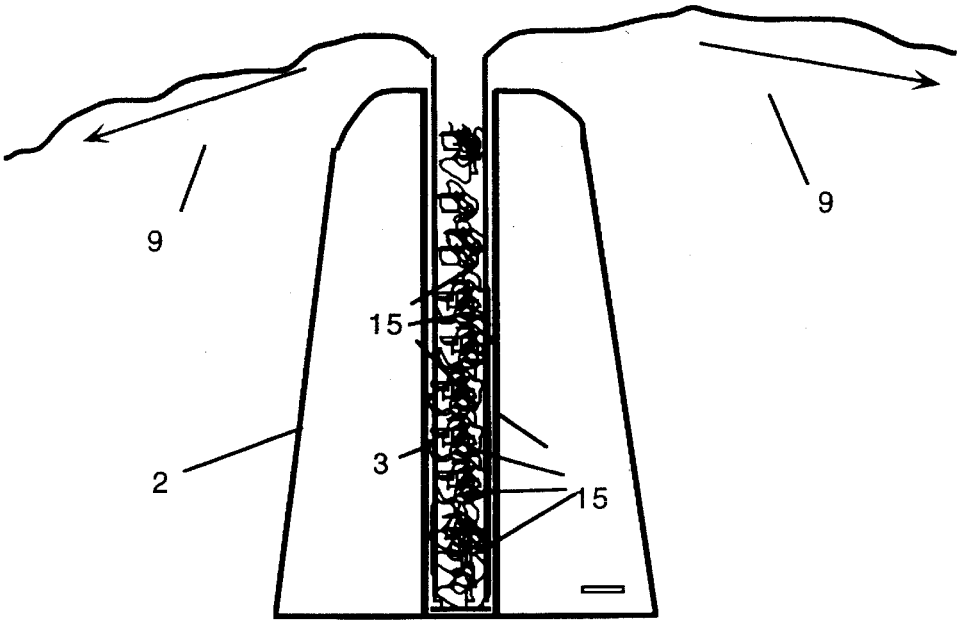
FIG. 11 is a cross-sectional view of the device with the eruption material loaded.
Figure 12:
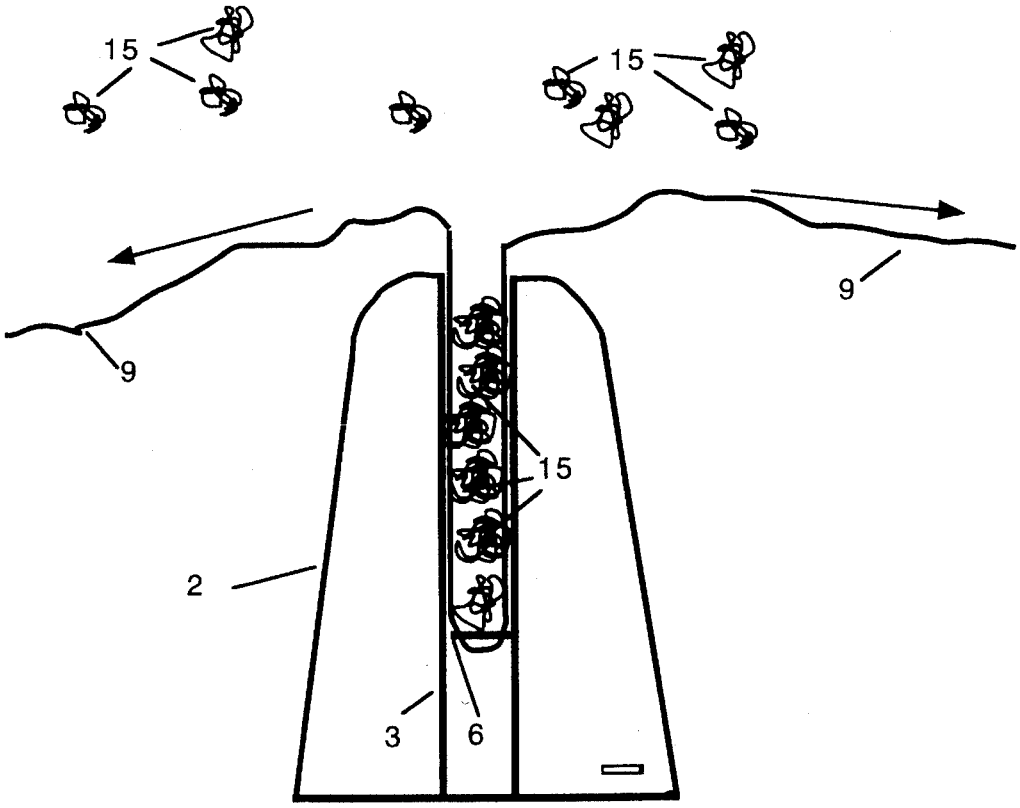
FIG. 12 is a cross-sectional view of the device with the eruption disk partially removed.
Figure 13:
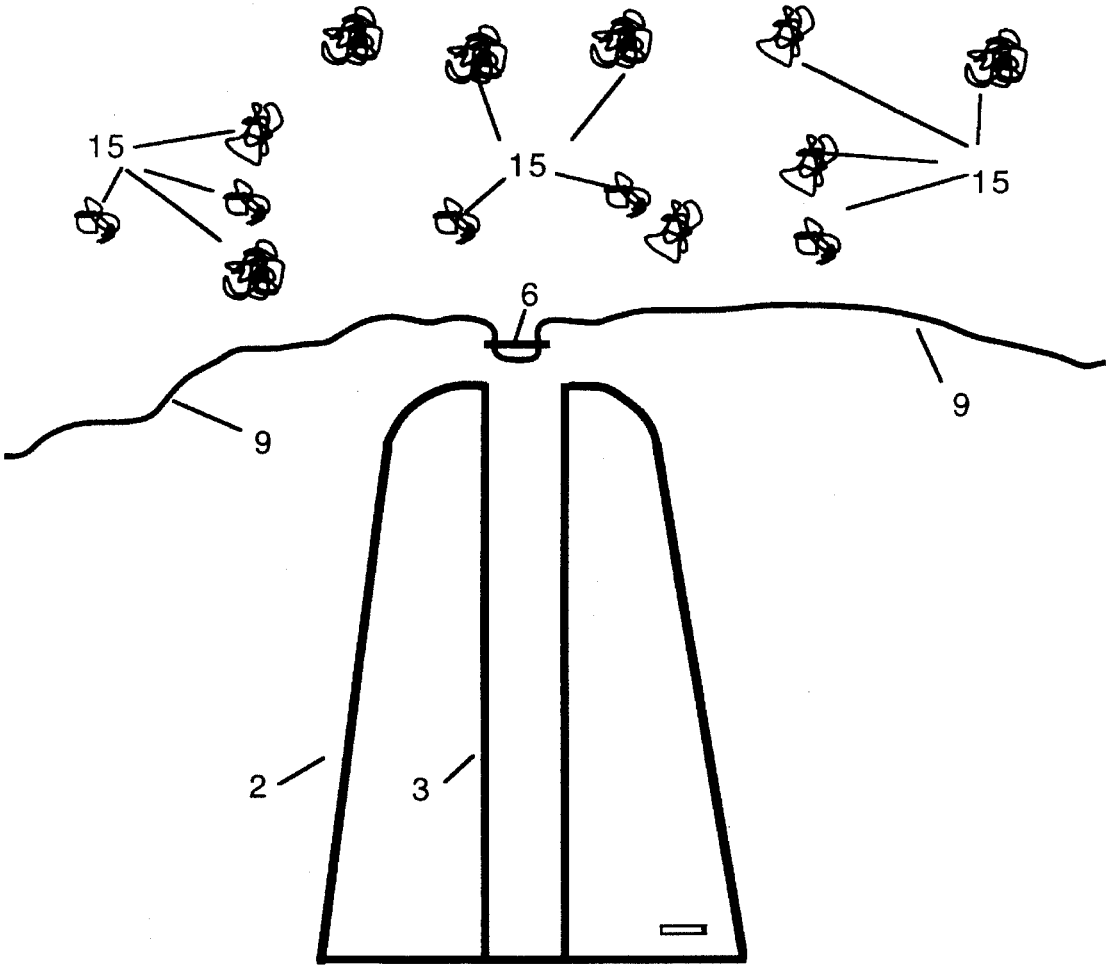
FIG. 13 is a cross-sectional view of the device with the eruption disk fully removed.

FIGS. 11–13, depict the typical operation of the device in cross section. FIG. 11 shows the device fully loaded, ready for an "eruption." Here, the eruption disk 6 is placed at the bottom of the eruption tube 3. The ribbon 9, which has been passed through the slots 8 in the eruption disk 6, (see FIG. 10) is extended upward and out of the eruption tube 3 as shown. A number of eruption objects 15 are packed into the eruption tube 3 as shown. The eruption objects 15 can be any non-liquid discrete-part material, such as beans, candy pieces, pebbles, sand or any similar type object. The ribbon 9 extends past the eruption objects 15 and is placed on opposite sides of the volcano shell 50. To use the device, the ribbon 9 is pulled quickly at each end. This causes the eruption disk 6 to be pulled upwards through the eruption tube 3, displacing the eruption objects 15 as it goes. FIG. 12 shows this process in operation. FIG. 13 shows the end of the process. Here, the eruption disk 6 has been completely removed from the eruption tube 3. The eruption objects 15 have been dispersed.

In practice the faster the ribbon 9 is pulled, the faster the eruption disk 6 rises in the eruption tube 3. The increased speed imparts increased momentum to the eruption objects 15, causing them to disperse faster and farther from the volcano shell 50. This gives an exciting eruption effect.

Figure 14:
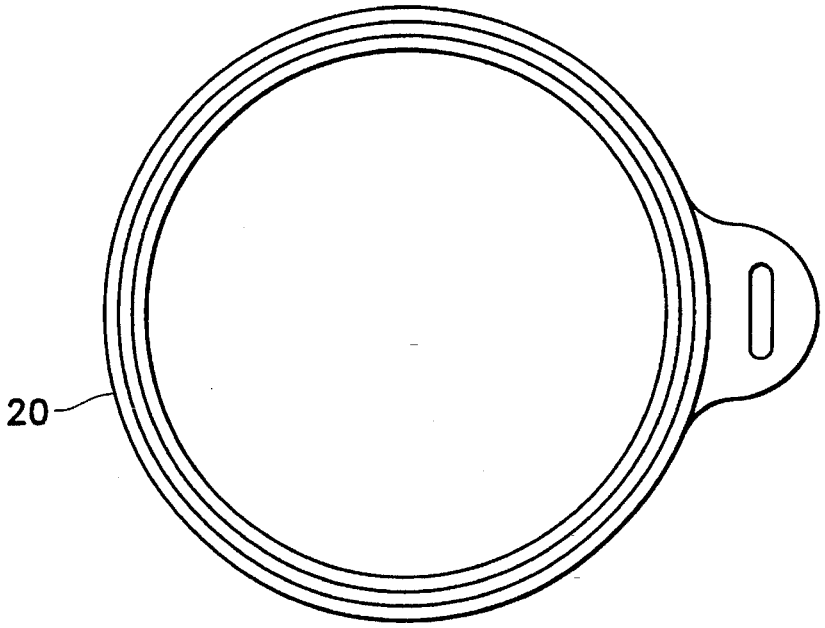
FIG. 14 is a top view of the sealing lid.
Figure 15:
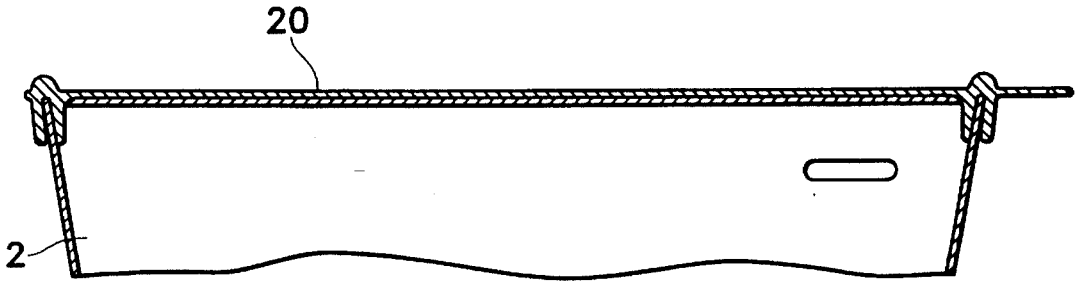
FIG. 15 is a side detail view of the bottom of the mold portion with the sealing lid snapped into place.
Figure 16:
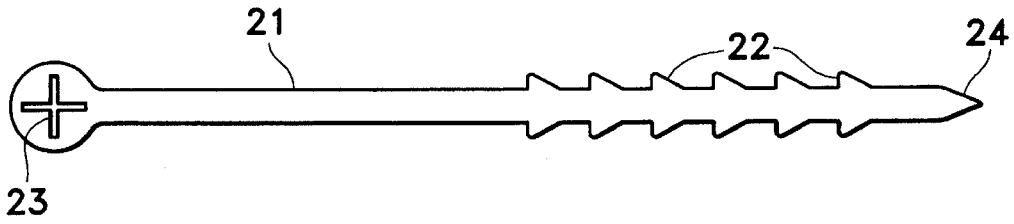
FIG. 16 is a top view of the locking strap that secures the components together for storage.

Referring now to FIGS. 14–16, two different storage means are provided. First, lid 20 is provided to seal the bottom of the mold form 2. The eruption tube 3, the eruption disk 6 and the ribbon 9 can be stored within the mold form 2 and then sealed within the mold form 2 by the lid 20. FIG. 15 shows the lid 20 snapped into place on the mold form 2.

The second means for storing the objects uses a locking strap 21 to secure all of the items to the outside of the mold form 2. The locking strap 21 fits through the slots provided in the mold form 2, the eruption tube 3, the eruption disk 6, and the lid 20 to prevent them from separating the components thus linked are suspended outside the mold form 2. Storing the components in this way permits the stored units to be stacked or nested for storage or shipment Referring now to FIG. 16, the locking strap 21 is designed to be releasable so that it can be reused. The locking strap 21 has a number of triangular tabs 22 that fit through a slot 23 on the top of the locking strap 21. This end 24 of the locking strap 21 is passed through slot 23 until a desired number of tabs 22 have passed through the slot 23. The end 24 is released and the tabs 22 are blocked from passing through the slot 23 until the tabs 23 are again released.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A simulated toy volcano comprising:

a) an outer shell having a top and a bottom, having a hollow, cylindrical center formed therein;

b) an eruption disk, having a perimeter, placed in the bottom of said hollow, cylindrical center such that said eruption disk is not connected to said cylindrical center in any way;

c) means for causing said eruption disk to be upwardly propelled through said hollow, cylindrical center and completely out of said hollow cylinder, said means for causing comprising a length of ribbon material attached to said eruption disk, being of sufficient length that said ribbon material extends along said cylindrical center and outside said shell to act as handles to enable disk movement; and d) a plurality of eruption objects, removably placed with said hollow, cylindrical center above said eruption disk such that as said eruption disk is upwardly propelled and completely ejected from said cylinder, said plurality of eruption objects is upwardly and outwardly propelled from the top of said hollow, cylindrical center.

2. The simulated toy volcano of claim 1 wherein said eruption disk has a side wall formed around the perimeter of said eruption disk.

3. The simulated toy volcano of claim 1 wherein said plurality of eruption objects are selected from the group consisting of: candy pieces, small stones, beans, and confetti.

4. The simulated toy volcano of claim 1 wherein said ribbon material is attached to said eruption disk by a pair of slots formed in said eruption disk, through which said ribbon material is passed.

5. A simulated toy volcano kit for creating a simulated volcano having an outer volcano shell and causing simulated eruptions comprising:

a) means for forming the outer volcano shell with said outer volcano shell having a hollow center portion;

b) a central cylindrical tube, having a top and a bottom, removably placed in the hollow center portion of said outer volcano shell;

b) an eruption disk, having a perimeter, placed in the bottom of said central cylindrical tube;

c) means for causing said eruption disk to be upwardly propelled through said central cylindrical tube, said means for causing comprising a length of ribbon material attached to said eruption disk, being of sufficient length that said ribbon material extends along said cylindrical center and outside said shell to act as handles to enable disk movement;

d) a plurality of eruption objects, removably placed with said central cylindrical tube above said eruption disk such that as said eruption disk is upwardly propelled said plurality of eruption objects is upwardly and outwardly propelled from the top of said central cylindrical tube; and e) means for storing the central cylindrical tube, eruption disk, and the means for causing said eruption disk to be upwardly propelled, within said means for forming an outer volcano shell.

6. The simulated toy volcano of claim 5 wherein said eruption disk has a side wall formed around the perimeter of said eruption disk.

7. The simulated toy volcano of claim 5 wherein said plurality of eruption objects are selected from the group consisting of: candy pieces, small stones, beans, and confetti.

8. The simulated toy volcano of claim 5 wherein the means for forming an outer volcano shell having a hollow center portion, comprise a mold form and a quantity of moldable shell material such that said quantity of moldable shell material being placed within said mold form and when said quantity of moldable shell material is cured, said mold form is inverted and removed, a solid volcano shell, having a hollow center portion is left.

9. The simulated toy volcano of claim 5 wherein the means for said ribbon material is attached to said eruption disk by a pair of slots formed in said eruption disk, through which said material is passed.

10. The simulated toy volcano of claim 8 wherein said quantity of moldable shell material is selected from the group consisting of: gelatin food products, flavored cake mixes, clay, earth, sand and paper-mâché.

* * * * *